United States Patent [19]

Foster

[11] 3,932,235

[45] Jan. 13, 1976

[54] METHOD OF IMPROVING THE CORE-LOSS CHARACTERISTICS OF CUBE-ON-EDGE ORIENTED SILICON-IRON

[75] Inventor: Karl Foster, Pittsburgh, Pa.

[73] Assignee: Westinghouse Electric Corporation, Pittsburgh, Pa.

[22] Filed: May 7, 1974

[21] Appl. No.: 467,696

Related U.S. Application Data

[63] Continuation-in-part of Ser. No. 382,267, July 24, 1973, abandoned.

[52] U.S. Cl. ..... 148/113; 148/31.55; 148/112; 148/31.5

[51] Int. Cl.[2] ..... H01F 1/04

[58] Field of Search ..... 148/113, 122, 111, 31.55, 148/112, 31.5; 427/126

[56] References Cited

UNITED STATES PATENTS

| | | | |
|---|---|---|---|
| 3,116,179 | 12/1963 | Carpenter et al. | 148/113 |
| 3,159,511 | 12/1964 | Taguchi et al. | 148/113 |
| 3,333,993 | 8/1967 | Kohler | 148/113 |
| 3,523,837 | 8/1970 | Pavlik | 148/113 |
| 3,528,863 | 9/1970 | Foster et al. | 148/31.55 |
| 3,615,903 | 10/1971 | Perry et al. | 148/122 |
| 3,676,227 | 7/1972 | Matsumoto et al. | 148/111 |
| 3,700,506 | 10/1972 | Tanaka et al. | 148/111 |
| 3,785,882 | 1/1974 | Jackson | 148/113 |

*Primary Examiner*—Walter R. Satterfield
*Attorney, Agent, or Firm*—R. T. Randig

[57] ABSTRACT

A process is described in which an iron-silicon alloy capable of being heat treated to produce a cube-on-edge (110) [001] grain orientation is treated to produce improved core losses when the material is under high operating inductions. The process steps include cleaning the surface of the steel of finish gauge thickness, applying a coating to the surface of the steel which is non-reactive with the surface and promotes decarburization, heating to a temperature sufficiently high to effect secondary recrystallization texture development and decarburization and cooling to room temperature. Data are included which demonstrate the improved core losses exhibited by these materials so treated when tested at high operating inductions.

11 Claims, No Drawings

METHOD OF IMPROVING THE CORE-LOSS CHARACTERISTICS OF CUBE-ON-EDGE ORIENTED SILICON-IRON

This is a continuation-in-part of application Ser. No. 382,267 filed July 24, 1973, now abandoned, and is assigned to the same assignee.

BACKGROUND OF THE INVENTION

1. Field of the Invention

The present invention relates to those materials known in the trade as oriented silicon-irons and which normally contain about 3% silicon, about 0.1% manganese, between about 0.02 and about 0.03% sulfur and a balance essentially iron with incidental impurities. These alloys when properly processed are capable upon heat treatment of developing a preferred grain orientation which is known in terms of Miller indicies as (110) [001], which orientation has been described generically as "cube-on-edge".

2. Description of the Prior Art

The core materials which are employed in transformers today comprise an alloy containing nominally about 3.25% silicon and which has been processed to obtain a preferred grain orientation. The grain orientation, which is accomplished during the final heat treatment, has been characterized as an orientation resulting from the application of internal energy to certain preferentially aligned grain nuclei. When fully processed to obtain the desired orientation, the major portion of the grains have an orientation which has been described in terms of Miller indices as (110) [001] orientation or as a cube-on-edge orientation.

During final heat treatment of this material, the heat treatment takes place while the material is in a coil configuration. It is essential during such heat treatment that the individual convolutions of the coil must be provided with a material to insulate or separate the turns from one another since the heat treatment temperatures involved are sufficiently high that sticking or welding of the adjacent convolutions would occur except for the insulation provided thereto. This insulation has usually taken the form of a magnesium oxide coating which has been applied to the surface of the steel. During said final heat treatment some of the MgO reacts with the components of the surface of the steel including iron, oxygen and silicon to form a complex, tightly adherent layer of a magnesium silicate type glass coating on the surface of the steel. This tenacious film will permit the unwinding of the coil material by preventing adhesion of the adjacent convolutions of the coil. In addition, the glass which forms during said high temperature heat treatment also acts as an excellent electrical insulator which is highly useful when the material is used subsequently in electrical apparatus in the form of a stacked lamination or a wound core.

Attempts to improve the observed magnetic characteristics of the prior art material have usually been limited to the aspect of improvement in the core loss exhibited by the materials because the saturation induction value of the alloy material is essentially limited by its chemical composition. These attempts at improving the core loss have centered about the development of preferred orientations, higher purity content and alloying variations which tend to alter the effective resistance exhibited by the alloy.

It has been discovered that the prior art magnetic material and in particular the prior art silicon steel having a reacted MgO coating on the surface thereof, does not exhibit an optimum low core loss especially where the material is operated at high inductions. This is predicated on the fact that the magnesium silicate coating which forms during the high temperature annealing may be a factor in causing unfavorable stresses to be imparted to the underlying metal thereby adversely affecting the observed core loss. Other reasons which have been advanced for the non-optimum core loss at high operating inductions include the aspect of the interaction of the coating with the surface of the metal during high temperature heat treatment may be harmful and the coating which is formed may be an effective deterrent for removing certain impurities, particularly carbon, to the desired low level during said high temperature heat treatment operation.

In order to alleviate these factors the present invention employs a coating which is non-reactive with the surface of the steel and promotes purification of the alloy during said high temperature heat treatment operation particularly the decarburization of the underlying metal.

SUMMARY OF THE INVENTION

The present invention is directed to a method for improving the core loss characteristics at high operating inductions in iron-silicon alloys which are capable of developing a high proportion of the grains having (110) [001] orientation. Essentially, the method consists of employing finished gauge material which has been cold rolled in at least two operations, the final of which effects a reduction in cross-sectional area of between about 50% and about 75%. The cold rolled material is thereafter decarburized and may be subjected to a surface cleaning operation following which a coating is applied to at least one side of the finish gauge material which coating is non-reactive with the alloy and which allows further decarburization. Thereafter the coated material is heated to a temperature within the range between about 1,075°C and about 1,300°C for a time period of between about 6 hours and about 36 hours such heating and cooling to and from the heat treatment temperature range typically taking place at a rate of about 50°C per hour while maintaining a dry hydrogen atmosphere above the material. As processed, the alloy will exhibit improved core losses at operating inductions of 17 kilogauss and higher.

The present invention is also applicable to iron-silicon alloys which have been fully treated, that is, they have been subjected to a high temperature anneal for the purpose of developing the oriented grain texture. During such high temperature anneal the steel has been subjected to the formation of a magnesium silicate coating on the surface thereof by reason of the fact that prior to the transformation anneal, at least one side of the steel has been treated with a water-slurry of a magnesium oxide coating and thereafter assembled into coil configuration.

After the material has been subjected to said high temperature annealing heat treatment the present invention is applicable wherein the magnesium oxide coating is removed and thereafter the fully transformed material is subjected to the application of a non-reactive coating, such as alumina, which permits further decarburization, said coating being applied to at least one side of the steel and thereafter the steel is heated to a temperature within the range between 1,025°C and about 1,200°C for a period of up to about 6 hours. As thus treated the steel will show an improved coercive force and the core loss at inductions in excess of 17 kilogauss will show a similar substantial improvement.

The present invention is also applicable to a new commercially available steel which has been designated in the trade as a Hi-B steel. This steel characteristically exhibits an induction between about 19 and about 19.4 kilogauss when subjected to a field of 10 oersteds. This fully treated Hi-B steel also requires the removing of the adherent mill coating thereon and the subsequent application of a non-reactive coating, such as alumina, which is effective for decarburizing the steel during the subsequent heat treatment. The subsequent heat treatment once again is preferably carried out at a temperature within the range between 1,025°C and about 1,200°C for a period of up to 6 hours. Further improved core loss values and coercive force values can be obtained where the Hi-B steel subsequent to the high temperature treatment of this invention to effect decarburization is further treated by the application of a glass coating to the surface thereof, said glass coating being effective for maintaining the underlying steel in tension when the steel is cooled to room temperature. The glass coating which is applied to the Hi-B type steel preferably has a coefficient of thermal expansion of less than about $8.0 \times 10^{-6}$°C.

If the Hi-B steel is obtained in the semi-finished condition, i.e., prior to a final high temperature anneal, the present process is applicable for improving the coercive force and core loss thereof.

DESCRIPTION OF THE PREFERRED EMBODIMENT

The material to which the process of the present invention is applicable is iron base alloy containing nominally about 3% to 3.25% silicon and which may typically in ingot form have a silicon content ranging between about 2% and about 5%, about 0.1% manganese, from about 0.02 to about 0.03% sulfur and the balance essentially iron with incidental impurities. These components are melted and preferably cast into ingot form which is thereafter hot rolled to an intermediate gauge strip or band.

In hot working the ingot to the rolled band thickness, the material is preferably heated to a temperature in the range between about 1,200°C and the highest temperature that the material will withstand without producing that phenomenon known as "burning" which latter includes the liquification of low melting phases usually commencing at or adjacent to the grain boundaries of the "as cast" material. Heating to a high temperature in this range can be deferred if a two step practice is employed wherein the ingot is first hot rolled at a lower temperature to a slab or other intermediate hot worked product and thereafter the slab or other intermediate hot worked product is thereafter heated to said high temperature and then hot rolled into the hot rolled band. Good results may be obtained where the material is heated to a temperature of about 1,375°C and hot worked down to a gauge of about 0.08 inch in thickness. While other gauges can be utilized, namely gauges anywhere between about 0.06 and about 0.25 inch in thickness, it is preferred to aim for a thickness of about 0.08 inch.

Following hot working the hot band material is preferably descaled and may be annealed at this time followed by the initial stage of cold rolling. The initial cold working operation usually effects a reduction in cross-sectional area of between about 50% and about 75% of the hot work gauge cross-sectional area. Thereafter the sheet material is preferably given an intermediate strip anneal at a temperature within the range between about 800°C and 900°C following which, the sheet material is again descaled and cold worked to finish gauge, for example, a finish gauge thickness in the range between 0.006 to about 0.015 inch and preferably to a gauge of about 0.012 inch in thickness. The final cold working to finish gauge effects a reduction in cross-sectional area of between about 50% and about 75%.

In processing the prior art material, the finish gauge sheet steel is given a decarburizing annealing treatment. Preferably the decarburization annealing heat treatment takes place by means of a strip or strand anneal which is conducted at a temperature between about 760°C and about 870°C preferably in a hydrogen atmosphere having a dew point in excess of about +40°C. Following the decarburization anneal, the material, usually in coil form, is thereafter subjected to a box annealing heat treatment at a temperature of between about 1,100°C and about 1,300°C. According to the prior art practice, prior to the box annealing heat treatment however, the material in coil form or in any other form where the adjacent surfaces are touching requires the application thereto of an insulating separator coating which usually consists of a water slurry containing magnesium oxide or magnesium hydroxide powder, said slurry being applied to at least one surface of the steel which would be in contact with another steel surface or an adjacent convolution of a coil configuration. The MgO coating reacts with the components of the surface of the steel and forms a thin tenacious complex magnesium silicate type glass on the surface of the steel during said box annealing heat treatment.

On the other hand, the method of the present invention takes the finished gauge sheet material and typically cleans the surface of any oxide which may have formed and also removes any dirt or other foreign matter such as rolling oil which may have been employed in producing the material of the finish gauge thickness. Where the surface is cleaned, the same may be accomplished in any well-known matter, for example, vapor degreasing by trichloroethylene or mechanically cleaned such as by wheelabrating the surface of the material to remove any oxides or other foreign objects. It has been found that a clean surface is desired since it is the object of the present invention that the applied separator coating be totally non-reactive with the surface of the steel during the final heat treatment. While it is optional to interpose a preceding decarburizing anneal as is done in the prior art processing, such has not been found to be necessary as will appear more fully hereinafter with respect to certain of the data.

In the method of the present invention at least one side and preferably both sides of the clean finish gauge material is provided with a coating of a non-reactive substance which promotes decarburization during final heat treatment. Such coating comprises a slurry containing between about 30% and about 70% and preferably about 60% by weight of fine $Al_2O_3$ powder suspended in water comprising by weight from about 0.5% to about 4% of polyvinyl alcohol as a suspending agent all weights being based upon the weight of the water present. The $Al_2O_3$, which is suspended in the water solution containing polyvinyl alcohol, may be that product resulting from the removal of the water of hydration from Al $(OH)_3$ and more specifically, the kappa phase of $Al_2O_3$ powder. It has been found that such kappa phase alumina, when employed as the coating ingredient, is quite effective from the standpoint of being non-reactive with the components of the surface of the steel. In addition it has been found that kappa phase alumina greatly improves the level of decarburization which is achieved during the final high temperature box annealing heat treatment. Optimum results have been obtained where the alumina is in the form of a powder wherein all the particles are of a size of about −300 mesh and in no event should the alumina powder exceed an average particle size of about 100 mesh.

The slurry containing the non-reactive alumina powder is applied to at least one surface of the steel, though, where desired, both surfaces may be coated in order to more effectively decarburize the steel. Typical coating thicknesses usually run in the range between about 0.1 and about 0.3 mil in thickness per surface thus covered. Thus where the two surfaces are covered the total thickness of the material undergoing the high temperature heat treatment will range from anywhere between about 0.2 and about 0.6 mil in thickness greater than that of the finish gauge material. Where the slurry contains polyvinyl alcohol the coating can be dried prior to the high temperature heat treatment and it will remain sufficiently adhesive so as to permit coiling of the material or stacking of the laminations without unduly disturbing the continuity of the coating.

The coated coils or stacked laminations are thereafter charged into a box annealing furnace and heated to a temperature within the range between about 1,075°C and about 1,300°C and maintained at that temperature for a time period of between about 6 hours and about 36 hours, such heating and cooling to and from the heat treatment temperature typically being at a rate of about 50°C per hour. Throughout the heating, cooling and retention of the coated steel at the elevated temperature, a dry hydrogen atmosphere is preferably circulated, usually the hydrogen having a dew point of less than about −40°F. During the foregoing described heat treatment the underlying steel material will undergo a process in which certain grains having a preferred orientation will grow by secondary recrystallization and consume the majority of the non-preferredly oriented grains, said preferred orientation being that known as a cube-on-edge orientation or (110) [001] orientation. In addition to the orientation which is produced during the final heat treatment, certain of the components contained within the steel, aand notably carbon and sulfur, are removed therefrom and reduced to a desired low level. In addition, the anneal may also aid in the removal of the manganese sulfide particles which functioned within the microstructure of the steel in order to prevent grain growth until the desired orientation growth of the preferably oriented grains has taken place. Thereafter, the manganese sulfide particles are removed and grain growth permitted to proceed in order to obtain the optimum core loss properties.

It is believed that the heating and cooling rate of about 50°C per hour maximum both upon heating and cooling are typical in order to reduce to the minimum, the amount of thermal strains induced in the material during the heating and cooling process. By the reduction of such thermally induced strains, optimum core loss properties are ultimately developed.

Upon cooling to room temperature the alumina coating which was employed for separating the various convolutions of the coil may be readily brushed from the surface. During such heating of the material and holding at the elevated temperature, the organic constituent polyvinyl alcohol, readily vaporizes and is removed and since the alumina coating is non-reactive with the surface of the steel a light brushing will usually suffice for removing any remanents of the coating following said heat treatment. Thereafter the steel may be supplied with known prior art coating, for example, a magnesium phosphate formulation known in the trade as a "carlite" coating or a "sterling" varnish coating which will provide the necessary insulation to the adjacent steel members when they are stacked in laminated form. In some instances where it is desired to place the steel in tension for further improving the magnetic characteristics, the insulation coating will take the form of a glass coating, said glass having a coefficient of less than $8.5 \times 10^{-6}$ in/in/°F.

In order to more clearly demonstrate the improved properties obtainable by practicing the method of the present invention, reference may be had to the following:

Three semi-processed materials, that is, materials in the cold rolled condition, at final gauge all having a thickness of about 11 mils which corresponds to type M4 material were used to demonstrate the effectiveness of the present invention. Material No. 1 was received in the "as rolled" condition and had not been decarburized. Material No. 2 was in the final cold rolled condition but had been subject to a decarburization anneal in accordance with the prior art. Material No. 3 was in the decarburized condition. All of the samples were thoroughly cleaned prior to coating and annealing. The coating consisted of either the prior art MgO water slurry which would dry after application, or the alumina of the present invention was applied, and all final anneals consisted of holding at 1,200°C for a period of 24 hours in dry hydrogen, the materials having been heated and cooled at a rate of 50°C per hour.

TABLE I

| Sample No. | Coating | $H_c$ (Oe) | $B_{10}$ (G) | $Pc_{17/60}$ (W/lb) | % Si | % Mn | % C | % S |
|---|---|---|---|---|---|---|---|---|
| 1 | $Al_2O_3$ | 0.077 | 18,600 | 0.62 | 3.17 | 0.089 | 0.0020 | 0.0001 |
| 2 | $Al_2O_3$ | 0.093 | 18,600 | 0.65 | 2.99 | 0.076 | 0.0018 | 0.0001 |
| 3 | $Al_2O_3$ | 0.081 | 18,400 | 0.63 | 3.12 | 0.075 | 0.0013 | 0.0001 |
| 1 | MgO | 0.086 | 18,400 | 0.69 | 3.16 | 0.088 | 0.0024 | 0.0002 |
| 2 | MgO | 0.096 | 18,500 | 0.70 | 3.05 | 0.084 | 0.0037 | 0.0001 |

From the test results set forth in Table I it is immediately apparent that the method employing the alumina coating of the present invention as opposed to the MgO coating utilized by the prior art was effective in reducing the coercive force exhibited by the alloys. While the changes noted in the $B_{10}$ values were within experimental variances, but there was nonetheless a significant decrease in the core loss values of the alumina coated sheet compared with the same materials having been annealed employing the prior art MgO coating techniques. A 10% reduction in the $Pc_{17/60}$ values, that is from 0.69 to 0.62, in sample 1, for example, is extremely important and value in the transformer industry.

It is also believed significant that employing the process of the present invention resulted in lower carbon content being measured in the annealed material having the alumina coating which is a factor that thereby aids in the observed core loss exhibited by the material. Note that in sample 2 the carbon was reduced by 50% by employing alumina instead of MgO. Thus it can be seen that the losses at 17 kilogauss are quite low for the $Al_2O_3$ coated samples and would in fact represent a type M3 material which to date has only been obtained commercially by reduction of the alloy sheet thickness to about 9 mils.

The core losses of the MgO coated samples were significantly higher, approaching typical values obtained by prior art processing. It is believed that the MgO coating which adheres to and reacts with the steel is harmful to the production of low core loss values as compared with the $Al_2O_3$ coatings which neither adhered nor reacted with the surface of the metal.

Reference is directed to Table II in which the same materials were employed except for example No. 4 which was identical to sample No. 2 but in addition was given a high temperature strip anneal at 1,000°C prior to the final anneal.

TABLE II

| Sample No. | Coating | $H_c$ (Oe) | $B_{10}$ (G) | $Pc_{17/60}$ (W/lb) | %C |
|---|---|---|---|---|---|
| 1 | $Al_2O_3$ | 0.087 | 18,100 | 0.67 | 0.0008 |
| 2 | $Al_2O_3$ | 0.087 | 18,600 | 0.62 | 0.0008 |
| 4 | $Al_2O_3$ | 0.093 | 18,300 | 0.67 | 0.0006 |
| 1 | MgO | 0.090 | 18,000 | 0.73 | 0.0013 |
| 2 | MgO | 0.096 | 18,400 | 0.70 | 0.0021 |
| 4 | MgO | 0.097 | 18,200 | 0.74 | 0.0021 |

From the test results recorded in Table II, it is again seen that all samples with the $Al_2O_3$ coating had lower losses for the same starting material than the MgO coated sample. Coercive force values were lower for $Al_2O_3$ coated samples as were the carbon contents. It is once again noted that the core loss values exhibited by the alloys prove to be outstanding when the materials were processed in accordance with the teachings of the present invention as opposed to the core losses associated with the material having been coated by the prior art practices.

In order to demonstrate the effect of the MgO coating, sample No. 1 was annealed for 24 hours at 1,200°C employing the method of the present invention. The material was thereafter tested with the results set forth hereinafter in Table III and thereafter, the $Al_2O_3$ coating was removed and an MgO coating applied. The sample was then reannealed for 6 hours at 1,170°C. The reannealed material was also tested and the results set forth hereinafter in Table III.

TABLE III

| Anneal | Coating | $H_c$ (Oe) | $B_{10}$ (G) | $Pc_{17/60}$ (W/lb) |
|---|---|---|---|---|
| 24 hr 1200°C | $Al_2O_3$ | 0.085 | 18,200 | 0.67 |
| +6 hr 1170°C | MgO | 0.091 | 18,400 | 0.71 |

The test results in Table III show that the short time anneal with the MgO coating increased the coercive force and the core loss. Since MgO reacts with the components of surface of the steel to produce a magnesium silicate coating thereon, it is concluded that undesirable stresses are induced to the steel thereby resulting in the poorer observed core loss values as well as coercivity.

As stated previously, the method of the present invention is also applicable to fully processed silicon steel, that is, a steel which has been previously decarburized, annealed at an elevated temperature to develop the oriented grain texture in a secondary recrystallized microstructure. During the annealing process, the MgO coating which was normally applied, reacted with the components of the steel to form a tightly adherent magnesium silicate coating on the surface thereof. As thus received, the magnetic properties of the steel were measured and following testing the steel having the mill coating thereon was subjected to a pickling treatment for removing the magnesium silicate coating from the surface. This was done by subjecting the coated steel to a pickling solution containing approximately 5 parts of sulfuric acid, 5 parts of nitric acid, 1 part of hydrochloric acid, and 10 parts of water. Care was exercised to remove as little metal as possible during the coating removal with the result that the total reduction in thickness amounted to less than one-half mil per strip thickness. Thereafter 100 mesh calcined alumina was applied as a dry powder to the strip material and the steel was reannealed for 3 hours at a temperature of 1,050°C. The test results are set forth hereinafter in Table IV.

TABLE IV

Properties of Fully-Processed Hipersil (Nominal Thickness — 12 mils)

| Treatment | $H_c$ (Oe) | $B_{10}$ (kG) | 60 Hz Core Loss (W/lb) 17 kG | 18 kG |
|---|---|---|---|---|
| Mill Coated | 0.086 | 18.5 | 0.72 | 0.91 |
| Coating Removed | 0.087 | 18.4 | 0.71 | 0.86 |
| Reanneal $Al_2O_3$ | 0.078 | 18.4 | 0.63 | 0.77 |
| Mill Coated | 0.092 | 18.6 | 0.75 | 0.95 |
| Coating Removed | 0.099 | 18.3 | 0.73 | 0.87 |
| Reanneal $Al_2O_3$ | 0.088 | 18.4 | 0.63 | 0.77 |
| MgO Coated - Catalogue | 0.095 | 18.1 | 0.81 | 1.01 |

As noted from the test results set forth hereinbefore, the magnetic properties of the commercially fully processed mill coated silicon iron nominally 12 mils in thickness indicate low core loss values when compared with the catalogue values of the same type of material. The removal of the mill coating indicated that there was an increase in the coercive force of these samples and the 18 kilogauss core loss decreased somewhat. However, after treatment of the fully processed materials in accordance with the teachings of the present invention, the treated materials displayed a decrease in the coercive force and a substantial reduction in the core losses to values similar to those attained on the best previous samples.

It would appear that the main factor in obtaining these low losses is the elimination of the MgO coating which results in a lower final carbon content together with the aspect of the non-reactive character of the coating being effective for reducing the stresses and interaction between the coating and the surface of the metal. Thus the 60 Hz core loss values of as low as 0.63 watts per pound observed at 17 kilogauss in the material as treated in accordance with the process of the present invention results in an outstanding improvement of the core loss characteristics.

In recent years there has appeared on the commercial scene a product known as high permeability silicon steel and has been called Hi-B steel. This material, of substantially similar chemical composition to Type M-4 silicon steel, is characterized by an induction of at least 18.8 kilogausses when measured in a field of 10 oersteds. Typically, the commercially available material will exhibit a $B_{10}$ value of between about 19 and 19.4 kilogausses. The process of the present invention is also applicable to this steel; however, while core loss improvement is noted in practicing the present invention, maximum results are obtained by applying a glass coating to the steel after practicing the process of the present invention.

Fully processed Hi-B steel with the mill coating thereon was obtained and the magnetic characteristics determined. Thereafter the mill coating was removed, the steel tested, and then subjected to the process of the present invention. The test results are set forth hereinafter in Table V.

TABLE V

| Coil No. | Treatment | $H_c$ (Oe) | $B_{10}$ (kG) | 60 Hz Loss (W/lb) 17 kG | 18 kG |
|---|---|---|---|---|---|
| 273 | Mill Coated | 0.103 | 19.0 | 0.71 | 0.92 |
| 273 | Coating Removed | 0.105 | 19.1 | 0.76 | 0.91 |
| 273 | Invention | 0.095 | 19.2 | 0.69 | 0.79 |
| 279 | Mill Coated | 0.079 | 19.1 | 0.68 | 0.85 |
| 279 | Coating Removed | 0.073 | 19.2 | 0.74 | 0.88 |
| 279 | Invention | 0.068 | 19.3 | 0.68 | 0.78 |
| 288 | Mill Coated | 0.092 | 19.0 | 0.72 | 0.90 |
| 288 | Coating Removed | 0.086 | 19.2 | 0.78 | 0.93 |
| 288 | Invention | 0.075 | 19.4 | 0.69 | 0.79 |
| 6 | Mill Coated | 0.083 | 19.3 | 0.67 | 0.87 |
| 6 | Coating Removed | 0.073 | 19.6 | 0.71 | 0.81 |
| 6 | Invention | 0.061 | 19.7 | 0.65 | 0.73 |
| 22 | Mill Coated | 0.079 | 19.3 | 0.67 | 0.87 |
| 22 | Coating Removed | 0.069 | 19.6 | 0.67 | 0.78 |
| 22 | Invention | 0.063 | 19.6 | 0.64 | 0.71 |
| M5 (Catalogue) | MgO Coated | 0.095 | 18.1 | 0.81 | 1.01 |

The foregoing test results illustrate the improvement obtained in core loss and coercivity. In each instance it is believed that the improved magnetic characteristics are associated with the lower carbon contents.

Similar results have also been obtained where semi-finished Hi-B steel is employed and treated in the manner set forth hereinbefore with respect to sample No. 1.

Once again the test results confirm the improved coercive force and improved core loss exhibited by the material when employing the process of the present invention. Thus it becomes clear that considerably lower losses can be obtained in a commercial 3% silicon-iron than are normally observed in commercially fully processed material. The main factor in obtaining these low losses appears to be the elimination of the MgO coating which results in lower final carbon content together with the aspect of the nonreactive character of the coating being effective for reducing stresses and interaction between the coating and the surface of the metal. Thus with 60 Hz loss values as low as 0.62 watts per pound observed at 17 kilogauss in 11 mil material results in an outstanding improvement in the core loss characteristics.

I claim as my invention:

1. In the method of improving the core loss characteristics at high operating inductions of iron-silicon alloy members which are to be subjected to a final heat treatment for developing a "cube-on-edge" or (110) [001] orientation, the steps comprising, cleaning the surface of the alloy member to remove all oxides and other foreign matter therefrom which alloy member is in the cold rolled finish thickness condition, applying a coating to at least one side of the alloy member which coating comprises alumina in the form of a powder having an average particle size of about 300 mesh and in no event greater than 100 mesh, is non-reactive with the alloy and which promotes decarburization, heating the coated alloy to a temperature within the range between about 1,075°C and 1,300°C for a time period of between about 6 hours and about 36 hours, while maintaining a dry hydrogen atmosphere about said alloy.

2. The method of claim 1 in which the alloy is heat treated at a temperature within the range between 1,150°C and 1,250°C for a time period of about 24 hours.

3. In the method of improving the core loss characteristics at high operating inductions in an iron base magnetic alloy characterized by exhibiting a (110) [001] grain orientation in the finished product, the steps comprising, cleaning the surface of a member of the alloy to remove all oxides and other foreign matter therefrom, applying to at least one surface of the alloy a coating of $Al_2O_3$ having an average particle size of about 300 mesh, heating the coated alloy member to a temperature within the range between 1,150°C and 1,250°C while maintaining the coated alloy in a hydrogen atmosphere having a dew point of not in excess of −40°F for a time period of about 24 hours, the heating to and cooling from the heat treatment temperature range not exceeding about 50°C per hour, the coating cooperating with the alloy to lower the final carbon content to less than 0.0025% by weight.

4. In the method of improving the core loss characteristics at high operating inductions in iron-silicon alloys which have been subjected to a final heat treatment having a coating on the surface which coating reacts with the components of the surface during the development of a "cube-on-edge" (110) [001] orientation, the steps comprising, removing the reacted coating from the surface of the transformed alloy, applying a coating to at least one side of the alloy which coating is non-reactive with the alloy and which promotes decarburization, said coating comprising alumina having an average particle size of about 300 mesh and in no event greater than 100 mesh, heating the coated alloy to a temperature within the range between about 1,025°C and 1,300°C for a time period of up to 6 hours, while maintaining a dry hydrogen atmosphere about said alloy.

5. The method of claim 4 in which the alloy is heat treated at a temperature within the range between 1,150°C and 1,250°C for a time period of about 3 hours.

6. In the method of improving the core loss characteristics at high operating inductions in an iron base magnetic alloy characterized by exhibiting a (110) [001] and which has a reacted coating comprising the reaction product of the components of the surface of the alloy and an oxygen containing inorganic compound, removing the reacted coating from the surface of the alloy, applying to at least one surface of the alloy a coating of $Al_2O_3$ having an average particle size of about 300 mesh, heating the coated alloy to a temperature within the range between 1,150°C and 1,250°C while maintaining the coated alloy in a hydrogen atmosphere having a dew point of not in excess of −40°F for a time period of up to 6 hours, the heating to and cooling from the heat treatment temperature range not exceeding about 50°C per hour, the coating cooperating with the alloy to lower the final carbon content to less than 0.002% by weight.

7. In the process of producing a low loss high permeability silicon steel sheet, the steps comprising, removing from the surface of the sheet any metal oxides and other foreign matter, applying a layer of an aqueous slurry of alumina of an average particle size of less than −100 mesh on at least one clean surface of a cold rolled sheet of iron-silicon alloy of from about 3% to 3.25% silicon and of a thickness of from 5 to 15 mils, drying the applied slurry, stocking or coiling the sheet with the alumina as a sheet separator, heating the sheet with the applied alumina at the rate of about 50°C per hour up to a maximum temperature of between 1,025°C and 1,300°C, holding said maximum temperature for at least 3 hours, and circulating an atmosphere of hydrogen of a dew point of not more than −40°C about said sheet during the heating, to decarburize said sheet alloy to a final carbon content of less than 0.002% and to cause the alloy to secondarily recrystallize to provide a (110) [001] grain texture in the sheet.

8. In the method of improving the core loss characteristics at high operating inductions in iron-silicon alloys which are capable of developing a "cube-on-edge" or (110) [001] orientation and which are characterized by exhibiting an induction ($B_{10}$) of 19 kilogausses at a field strength of 10 oersteds, the steps comprising, removing from the surface of the alloy of finish gauge thickness all oxides and other foreign matter, applying to at least one surface of the alloy a slurry comprising alumina having an average particle size of about 300 mesh and in no event greater than 100 mesh, which slurry is non-reactive and which promotes decarburization, heating the coated alloy to a temperature within the range between about 1,025°C and about 1,300°C for a period of time to effect decarburization while maintaining a dry hydrogen atmosphere about said alloy.

9. The method of claim 1 in which the alloy members are further treated by fusing a layer of a glass to the surface thereof, said glass having a coefficient of thermal expansion of less than $8.5 \times 10^{-6}$ in/in/°F and a thickness within the range between 0.1 and 0.3 mil per treated surface.

10. The method of claim 4 in which the alloy members are further treated by fusing a layer of a glass to the surface thereof, said glass having a coefficient of thermal expansion of less than $8.5 \times 10^{-6}$ in/in/°F and a thickness within the range between 0.1 and 0.3 mil per treated surface.

11. The method of claim 8 in which the alloy members are further treated by fusing a layer of a glass to the surface thereof, said glass having a coefficient of thermal expansion of less than $8.5 \times 10^{-6}$ in/in/°F and a thickness within the range between 0.1 and 0.3 mil per treated surface.

* * * * *